US011335529B2

(12) United States Patent
Jensen et al.

(10) Patent No.: US 11,335,529 B2
(45) Date of Patent: May 17, 2022

(54) THERMALLY ENHANCED COMPOUND FIELD EMITTER

(71) Applicant: The Government of the United States of America, as represented by the Secretary of the Navy, Arlington, VA (US)

(72) Inventors: Kevin Jensen, Washington, DC (US); Michael McDonald, Washington, DC (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/353,703

(22) Filed: Jun. 21, 2021

(65) Prior Publication Data

US 2021/0407758 A1 Dec. 30, 2021

Related U.S. Application Data

(60) Provisional application No. 63/041,613, filed on Jun. 19, 2020.

(51) Int. Cl.
*H01J 1/304* (2006.01)

(52) U.S. Cl.
CPC ..... *H01J 1/304* (2013.01)

(58) Field of Classification Search
CPC ..... H01J 1/3044
USPC ..... 313/346 R
See application file for complete search history.

(56) References Cited

U.S. PATENT DOCUMENTS

| | | | | |
|---|---|---|---|---|
| 10,083,812 | B1 * | 9/2018 | Mackie | H01J 9/025 |
| 2008/0252194 | A1 * | 10/2008 | Kuroiwa | H01J 31/127 313/496 |
| 2018/0174794 | A1 * | 6/2018 | Delgado | H01J 37/28 |
| 2020/0208276 | A1 * | 7/2020 | Lee | C25B 11/00 |
| 2021/0050172 | A1 * | 2/2021 | Liu | H01J 37/073 |

* cited by examiner

*Primary Examiner* — Christopher M Raabe
(74) *Attorney, Agent, or Firm* — US Naval Research Laboratory; Richard Bis

(57) ABSTRACT

A compound field emitter (CFE) includes a first surface possessing a field enhancement factor >1, and a second surface possessing one or both of a field enhancement factor >1, or a low work function, wherein the second surface is coated, formed or applied upon the first surface. The second surface has a characteristic size at least 3 times smaller than the first surface, and the outer surface includes a coating of calcium aluminate 12CaO-7Al2O3.

8 Claims, 1 Drawing Sheet

*The whole is the product of its parts:*
*A $\beta = 3$ sphere on a $\beta = 10$ cone yields $\beta = 30$*

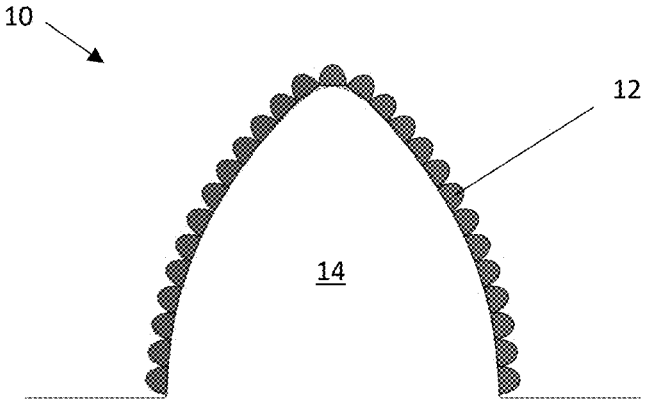
*The whole is the product of its parts:*
*A* $\beta = 3$ *sphere on a* $\beta = 10$ *cone yields* $\beta = 30$

THERMALLY ENHANCED COMPOUND FIELD EMITTER

RELATED APPLICATIONS

This application claims the benefit of U.S. Provisional Application No. 63/041,613 filed Jun. 19, 2020, which is hereby incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, D.C. 20375, USA; +1.202.767.7230; techtran@nrl.navy.mil, referencing NC 109863.

FIELD OF INVENTION

The present invention relates generally to electron emission, and more particularly to an improved compound field emitter.

BACKGROUND

Thermal and field emission are well understood means of electron emission from a material. Both rely on some means of overcoming an energy barrier to allow an electron to escape the material into vacuum. In thermal emission a material's bulk temperature is raised to the point where a portion of the electron population has sufficient energy to escape the material, akin to the evaporation of water. In field emission a sufficiently strong electric field is applied to the material to permit electrons to tunnel quantum mechanically through the energy barrier to escape the material.

The figure of merit for thermal emitters is the work function $\Phi$, a measure of the energy barrier height that heating must overcome. The figure of merit for field emitters is the ratio of $\Phi^{3/2}$ with the surface field, making the field enhancement factor (how much the geometry of the typically pointed emitter amplifies an electric field at the field emitter's surface) an additional figure of merit for field emitters. The difficulty in designing electron emitters is to reliably achieve a sufficiently low work function or high field enhancement factor to be useful for applications while also sufficiently robust and chemically inert to survive with a good lifetime in the application.

SUMMARY OF INVENTION

One technique to achieve these goals is to use these two mechanisms in combination. An approach is to coat a field emitting geometry with a low work function material to achieve what is known as thermal field emission, an enhanced level of emission due to a reduction in the effective work function of the material due to lowering of the energy barrier by the applied electric field. Some examples of prior art in this vein include coating carbon nanotubes (a field emitting structure) with low work function rare earth oxides (typical thermal emitters), coating silicon spikes (the field emitter) with diamond coatings (a negative electron affinity material, akin to a low work function material), or fashioning bulk transition metal carbides (relatively low work function materials) into sharp field-enhancing shapes via microfabrication techniques. Another approach is to coat a field-enhancing structure, such as a carbon nanotube, with nanoparticles of another material, such as ZnO. This provides additional field emission sites due to field enhancement over the small radius of the nanoparticles but is without special attention to orientation, order, placement, uniformity of coverage, or cumulative effects between the field enhancement of the base material and the field enhancement of the coating material. A final approach is to cap a field-enhancing structure such as a cone or a pillar with another field-enhancing structure, such as a cone or pillar of smaller diameter, to successively enhance a background electric field on the larger structure first and then the smaller structure. If the tip of the larger structure has a field enhancement factor of 5, and the tip of the smaller structure has a field enhancement factor of 10, the resulting compound or two-stage field emitter structure will then have a field enhancement factor of 50.

Disclosed is a rugged and high current electron emitter created by coating a field enhancing substrate of larger sized features with another field-enhancing structure of smaller features, where the second layer has a low work function surface to provide thermal enhancement to the field emission via thermal-field and/or pure thermal emission. The coating layer may be either a single material possessing both small-scale field-enhancing features and a low work function, or else may potentially itself be a material with small-scale field-enhancing features coated further with a low-work function coating as a third layer.

According to one aspect of the invention, a compound field emitter (CFE) includes a first surface possessing a field enhancement factor >1, and a second surface possessing one or both of a field enhancement factor >1, or a low work function, wherein the second surface is coated, formed or applied upon the first surface. The second surface has a characteristic size at least 3 times smaller than the first surface, and the outer surface includes a coating of calcium aluminate 12CaO-7Al2O3.

Optionally, the first surface is one of a hemisphere, cone, pillar, or spike.

Optionally, the characteristic size is one of height or radius of curvature.

Optionally, the CFE is in combination with one or more other like CFEs arranged in an array.

Optionally, the first surface comprises a substrate of patterned sapphire, black silicon or carbon nanotubes.

Optionally, the CFE includes an additional field-enhancing layer of intermediate size between the first and second layers.

Optionally, the CFE of claim 1, includes an intermediate bonding layer between layers for enhanced adhesion or electrical contacting.

Optionally, the intermediate bonding layer is titanium or platinum.

The foregoing and other features of the invention are hereinafter described in greater detail with reference to the accompanying drawings.

BRIEF DESCRIPTION OF THE DRAWINGS

FIG. 1 shows a schematic cross-sectional diagram of an exemplary compound field emitter.

DETAILED DESCRIPTION

Exemplary embodiments of the invention use thermal and field emission together in a new way by combining a compound or two-stage field emitter with a thermal emitter.

The difficulty of fabricating compound emitters alone is such that it is generally only tackled in theory. Furthermore, it is sufficiently complex that no previous attempts have been made to graft thermal emission onto the structure (single tip Schottky ZrO emitters are said to be "thermal-field" but in fact use high fields to lower a high work function barrier and enhance only the thermionic emission component).

Advantages of exemplary embodiments include:

- An improved field enhancement factor over that of the field-enhancing substrate due to the native field-enhancing surface of the active material
- Eased fabrication difficulties on the initial substrate because it is not responsible for either the electron emission or all of the field enhancement—can be larger, duller, made of an inert or arbitrary substance, because emission happens via the coating
- Larger total current achievable than pure field emission arrays because the thermal emission, while lower current density, happens over a much larger area and can thus produce a much larger total current if desired Referring to FIG. 1, an exemplary compound field emitter 10 may include a thin film of a nanostructured material with low work function 12 coated onto a microstructured substrate 14. In a uniform background electric field the substrate enhances the electric field over the coating, which then additionally concentrates the already enhanced electric field, resulting in an exceptionally strong electric field at the tip of the microstructure and potentially a smaller but still significant field over the sidewalls. This two-stage field enhancement produces strong field emission at the tip, thermal-field emission along the sidewalls, and depending on the inter-tip spacing in an array, a region of pure thermal emission in the valleys between tips.

A thin film of 12CaO-7Al2O3 (hereafter C12A7) may be used as the coating. C12A7 has a natural cage-like crystal structure with approximately spherical cages about 0.5 nm in diameter. The unit cell has a positive net charge and charge neutrality is maintained by incorporating extra-framework negative species or anions into the cages. The typical anion is $O^{2-}$ but under an oxygen reduction process the oxygen can be removed leaving free electrons in the cages. The resulting material is 12CaO-7Al2O3:4e–, or C12A7 electride. The electride is a metallic conductor with low work function due to the formation of a new cage conduction band as electrons travel freely between cages. The material also exhibits strong field and thermal field emission, likely due to the small size of the cages and associated strong field enhancement at their surface. As a result, C12A7 natively combines both a field-enhancing surface and a low work function bulk material suitable for coating onto a field-enhancing substrate.

The C12A7 may be coated in a thin film on a patterned sapphire substrate (PSS), a widely commercially available substrate consisting of approximately unit aspect ratio micron-diameter cones with tip diameter ~100 nm and pitch of order single-integer cone diameter available on wafers up to several inches in diameter. A common specific arrangement is of a 1.6 um tall cone with 2.5 um base diameter and 3 um pitch.

Finally, the coating of the low work function field enhancing coating on the larger field-enhancing substrate may be modeled using a mathematical model that allows estimates of the ideal inter-tip spacing based on a desired grid layout (triangular or square) and tip geometry to minimize shielding effects where one emitter could "shadow" another and cause reduced overall emission.

The result is that exemplary embodiments:

- Enhance field emission at substrate tip not just by lower work function coating but by a nanostructured low work-function coating
- Achieve not just enhanced field emission at the apex (topmost tip) but also enhanced thermal-field emission over much of tip sidewall (which could be much greater overall current due to much larger overall area)
- Tune inter-tip spacing to minimize shielding effects and thus optimize aggregate current density over many tips (vs. many of the CNT or nanowire cases which tend to have emitter tips packed so close that sidewalls touch, and thus lose field enhancement)
- Use C12A7 on a patterned substrate as a particular but nonexclusive way to do all the above.

C12A7 is somewhat conductive, and patterned sapphire substrates (PSS) are ubiquitous and affordable, so a coating of C12A7 on a bare PSS may work sufficiently well for some applications. However, it may also be beneficial to retain the PSS but apply a thin film conducting coating, perhaps with vias to a conductive backplane, to achieve high electrical conductivity to the emitting surfaces. Alternatively, a different substrate material entirely may be used for patterning the emitter tip array using standard semiconductor techniques to fashion arrays of sharp points or pillars, for example in silicon. Moreover, either a thin film coating over such semiconductor or insulator substrates, or manufacturing the substrate from a conductive metal like copper or gold, or a high temperature material like molybdenum or tungsten could be used. Additionally, use of a substrate consisting of nanowires, made of a material such as ZnO, or nanotubes made of a material like carbon, instead of the conical PSS tips is possible. Note that nanowires and nanotubes still have diameters and especially lengths typically much larger than the sub-nanometer C12A7 cages.

While potentially more difficult, a similar concept of a thermally enhanced compound field emitter could also be achieved by decoupling the second stage field enhancement and the thermal emitter. For example, patterning a larger field-enhancing substrate with smaller nanoparticles, and then coating the combination in a low work function material, could offer advantages in tailoring the relative contributions of field and thermal emission. An example of a process here could be to coat the carbon nanotubes in ZnO nanoparticles, and to then coat the combination in a monolayer of low work function material. Potential low work function materials that might be suitable for coating over already very small protrusions like nanoparticles include 2D materials such as the electrides Ca2N or Y2C.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A compound field emitter (CFE) comprising: a first surface possessing a field enhancement factor >1, and a second surface one or both of a field enhancement factor >1, or a low work function, wherein the second surface is coated, formed or applied upon the first surface, wherein the second surface has a characteristic size at least 3 times smaller than the first surface, and wherein the second surface includes a coating of calcium aluminate 12CaO-7Al2O3.

2. The CFE of claim 1, wherein the first surface is one of a hemisphere, cone, pillar, or spike.

3. The CFE of claim 1, wherein the characteristic size is one of height or radius of curvature.

4. The CFE of claim 1 in combination with one or more other CFEs according to claim 1 arranged in an array.

5. The CFE of claim 1, wherein the first surface comprises a substrate of patterned sapphire, black silicon or carbon nanotubes.

6. The CFE of claim 1, further comprising an additional field-enhancing layer of intermediate size between the first and second layers.

7. The CFE of claim 1, further comprising an intermediate bonding layer between layers for enhanced adhesion or electrical contacting.

8. The CFE of claim 7, wherein the intermediate bonding layer is titanium or platinum.

* * * * *